US010804643B2

(12) United States Patent
Tada et al.

(10) Patent No.: US 10,804,643 B2
(45) Date of Patent: Oct. 13, 2020

(54) WATERPROOF CONNECTOR

(71) Applicant: Japan Aviation Electronics Industry, Limited, Tokyo (JP)

(72) Inventors: Takashi Tada, Tokyo (JP); Yohei Yokoyama, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 16/401,181

(22) Filed: May 2, 2019

(65) Prior Publication Data

US 2020/0076118 A1 Mar. 5, 2020

(30) Foreign Application Priority Data

Aug. 30, 2018 (JP) ..... 2018-161648

(51) Int. Cl.

| | |
|---|---|
| ***H01R 13/52*** | (2006.01) |
| ***H01R 13/41*** | (2006.01) |
| ***H01R 13/73*** | (2006.01) |
| ***H01R 13/6585*** | (2011.01) |
| *H01R 33/965* | (2006.01) |

(52) U.S. Cl.

CPC ..... *H01R 13/5219* (2013.01); *H01R 13/41* (2013.01); *H01R 13/5202* (2013.01); *H01R 13/6585* (2013.01); *H01R 13/73* (2013.01); *H01R 13/52* (2013.01); *H01R 13/521* (2013.01); *H01R 33/965* (2013.01)

(58) Field of Classification Search

CPC .. H01R 13/5219; H01R 13/521; H01R 13/52; H01R 13/41; H01R 33/965

USPC ..... 439/271, 274

See application file for complete search history.

(56) References Cited

U.S. PATENT DOCUMENTS

| | | | | |
|---|---|---|---|---|
| 2015/0333435 | A1* | 11/2015 | Arai | H01R 12/716 439/589 |
| 2016/0294105 | A1 | 10/2016 | Zhao et al. | |
| 2017/0302037 | A1* | 10/2017 | Yao | H01R 24/60 |
| 2017/0338586 | A1* | 11/2017 | Wang | H01R 13/5219 |
| 2017/0346216 | A1* | 11/2017 | Tada | H01R 13/41 |
| 2018/0054020 | A1* | 2/2018 | Tada | H01R 13/424 |

FOREIGN PATENT DOCUMENTS

CN 105470697 B 6/2018

* cited by examiner

*Primary Examiner* — Abdullah A Riyami
*Assistant Examiner* — Justin M Kratt
(74) *Attorney, Agent, or Firm* — Muncy, Geissler, Olds & Lowe, P.C.

(57) ABSTRACT

A waterproof connector includes a plurality of contacts each extending in a fitting direction, a housing configured to hold the plurality of contacts and a mid-plate made of metal arranged to face the plurality of contacts, the plurality of contacts each including a contact-side waterproof shaped portion, a contact front portion, and a contact back portion, the mid-plate including a front portion, a rear portion, and a coupling portion for coupling the front portion with the rear portion such that a gap is formed therebetween and having a mid-plate-side waterproof shaped portion, a length in the fitting direction of a portion of the gap facing one part of contacts among the plurality of contacts and a length in the fitting direction of another portion of the gap facing the other part of contacts differing from each other.

29 Claims, 10 Drawing Sheets

WATERPROOF CONNECTOR

BACKGROUND OF THE INVENTION

The present invention relates to a waterproof connector, particularly to a waterproof connector including pairs of contacts for high-speed signal transmission.

In recent years, portable electronic apparatuses have been widely used. These electronic apparatuses are highly demanded to have waterproof function, along with promoting reduction in thickness, and a connector used for the electronic apparatuses is required to be thin and to have waterproofness as well.

In addition, connectors shielded against electromagnetic waves are in a process of development in order to prevent electric signals transmitted from being influenced by external electromagnetic waves.

Such a waterproof connector having both waterproofness and electromagnetic-wave shielding properties is disclosed, for example, in CN 105470697 B. As shown in FIG. 26, the connector has a configuration in which a mid-plate 5 made of metal is disposed between an upper module 2 including a plurality of upper contacts 1 and a lower module 4 including a plurality of lower contacts 3, an insulator 6 are molded such that the upper module 2, the lower module 4, and the mid-plate 5 are held by the insulator 6, and the outer peripheral portion of the insulator 6 is covered with a metal shell 7, and further, a waterproof plate 8 is formed by potting on the back portion of the insulator 6. In addition, a gasket 9 is disposed on the outer peripheral portion of the metal shell 7.

The waterproof plate 8 formed on the back portion of the insulator 6, even if the plurality of upper contacts 1, the plurality of lower contacts 3, and the mid-plate 5 that are disposed inside the metal shell 7 protrude to the back portion of the metal shell 7, prevents water from entering the back portion of the metal shell 7 from the interior portion thereof.

In addition, the mid-plate 5 made of metal and the metal shell 7 surrounding the peripheries of the plurality of upper contacts 1 and the plurality of lower contacts 3 allow a signal transmission to be performed while reducing the influence by electromagnetic waves.

Unfortunately, in order to form the waterproof plate 8 by potting, it is required that the insulator 6 be molded so that the upper module 2, the lower module 4, and the mid-plate 5 are held by the insulator 6, and then a potting material is injected into the back portion of the insulator 6 covered with the metal shell 7, and further, the potting material is cured, which takes time and labor to manufacture the connector.

In addition, in a case when a high-speed signal transmission is performed using the plurality of upper contacts 1 and the plurality of lower contacts 3, although it is desired that the mid-plate 5 faces each of the contacts over a sufficient length in order to minimize signal crosstalk, the mid-plate 5 that is lengthened along the contacts decreases the thickness of the resin disposed around the contacts, making it hard to provide high waterproofness by utilizing contractive force of resin.

Increasing the thickness of the resin disposed around the contacts in order to balance an improvement of the waterproofness with a minimization of the crosstalk causes the connector to increase in size, particularly to increase in thickness thereof.

SUMMARY OF THE INVENTION

The invention is made to solve the above-described issue of the related art, and aims to provide a waterproof connector with thin thickness, which has excellent waterproofness and can be simply manufactured, while allowing crosstalk to be minimized.

A waterproof connector according to the invention includes a plurality of contacts each extending in a fitting direction, the plurality of contacts being aligned, a housing configured to hold the plurality of contacts, and a mid-plate made of metal arranged to face the plurality of contacts, wherein the plurality of contacts each includes a contact-side waterproof shaped portion located at a middle portion in the fitting direction and embedded in the housing to block entry of water along the interface with the housing, a contact front portion located in front of the contact-side waterproof shaped portion in the fitting direction and having a contact portion to be in contact with a contact of a mating connector, and a contact back portion located behind the contact-side waterproof shaped portion in the fitting direction and having a connection portion to be connected to a connection target object, wherein the mid-plate includes a front portion in a flat plate-like shape facing the contact front portion of each of the plurality of contacts, a rear portion in a flat plate-like shape facing the contact back portion of each of the plurality of contacts, and at least one coupling portion for coupling the front portion and the rear portion with each other such that a gap is formed between the front portion and the rear portion, each of the at least one coupling portion having a mid-plate-side waterproof shaped portion embedded in the housing to block entry of water along an interface with the housing, and wherein a length in the fitting direction of a portion of the gap facing one part of contacts among the plurality of contacts and a length in the fitting direction of another portion of the gap facing the other part of contacts differ from each other.

DETAILED DESCRIPTION OF THE INVENTION

Embodiments of the invention will be described below with reference to the accompanying drawings.

Figure 1:
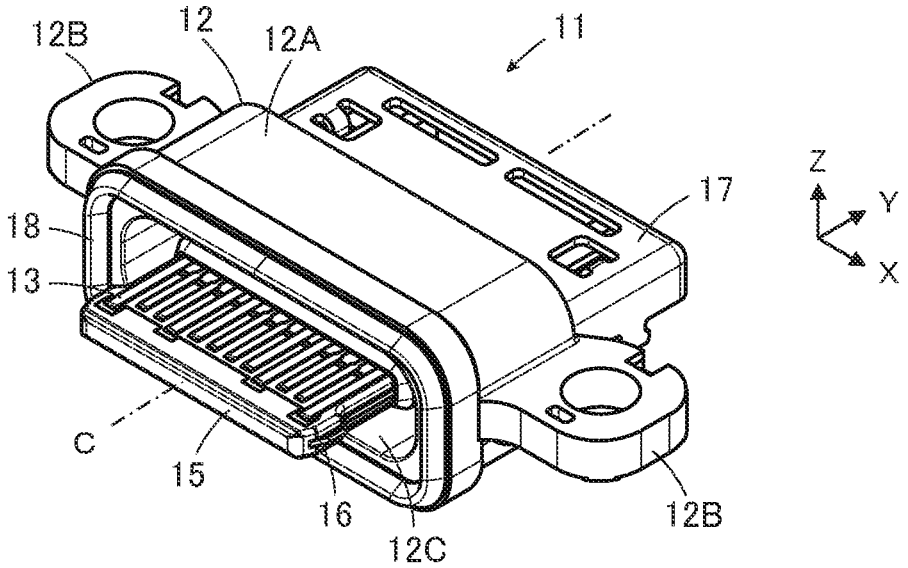
FIG. 1 is a perspective view of a waterproof connector according to an embodiment of the invention as viewed obliquely from above.
Figure 2:
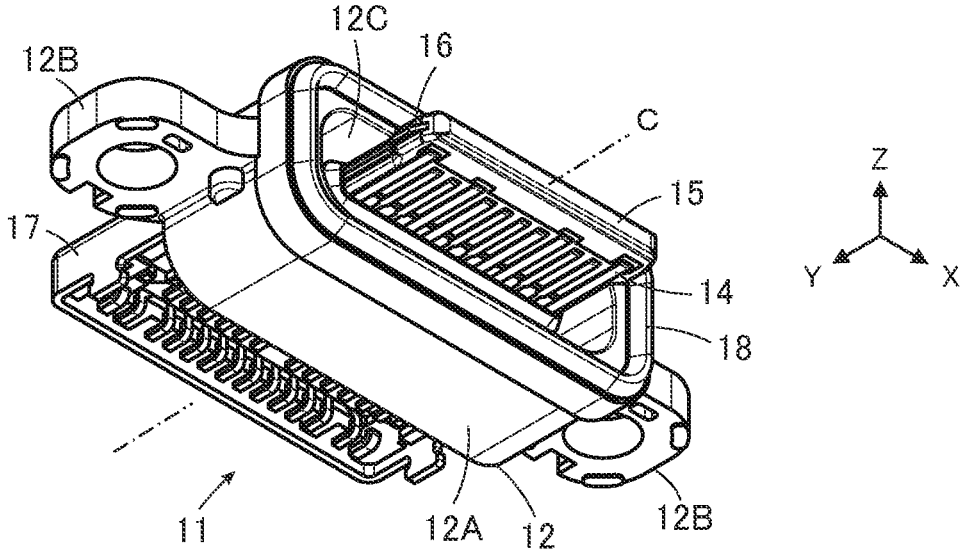
FIG. 2 is a perspective view of the waterproof connector according to the embodiment as viewed obliquely from below.

FIGS. 1 and 2 show a waterproof connector 11 according to an embodiment. The waterproof connector 11 is a receptacle connector to be fixed on a substrate in an electronic device such as a portable device or an information device and to be fitted to a mating connector (not shown) along a fitting axis C.

The waterproof connector 11 includes a housing 12, a plurality of first contacts 13 each extending in the direction of the fitting axis C and being aligned in a direction orthogonal to the fitting axis C, and a plurality of second contacts 14 each extending in the direction of the fitting axis C and being aligned in parallel with the plurality of first contacts 13. The plurality of first contacts 13 and the plurality of second contacts 14 are each made of a conductive material such as metal, and are held by the housing 12.

The housing 12 is made of an insulating resin and includes a tubular portion 12A in a flat tubular shape extending along the fitting axis C to cover around the plurality of first contacts 13 and the plurality of second contacts 14, and a pair of fixation portions 12B protruding from both side portions of the tubular portion 12A.

A mating connector receiving portion 12C into which a mating connector (not shown) is to be inserted is formed inside the tubular portion 12A. A tongue portion 15 being a part of the housing 12 is disposed in the mating connector receiving portion 12C. The tongue portion 15 is configured to hold front end portions of the plurality of first contacts 13 in the direction of the fitting axis C and front end portions of the plurality of second contact 14 in the direction of the fitting axis C, and a mid-plate 16 made of metal is disposed, being embedded in the tongue portion 15, between the plurality of first contacts 13 and the plurality of second contacts 14.

For ease of understanding, the direction from the front portion to the back portion of the waterproof connector 11 along the fitting axis C is referred to as a +Y direction, the alignment direction of the plurality of first contacts 13 and the plurality of second contacts 14 is referred to as a X direction, and the direction perpendicular to the XY plane and directed from the second contact 14 side to the first contact 13 side is referred to as a +Z direction.

A metal shell 17 that covers the end portions in the +Y direction of the plurality of first contacts 13 and the plurality of second contacts 14 is disposed on the +Y direction side of the tubular portion 12A.

On the end portion in the −Y direction of the tubular portion 12A, there is disposed a seamless waterproof member 18 that surrounds the end portion in the −Y direction of the mating connector receiving portion 12C.

The tongue portion 15 protrudes toward the −Y direction side relative to the tubular portion 12A. The plurality of first contacts 13 are aligned on the surface of the tongue portion 15 on the +Z direction side, while the plurality of second contacts 14 are aligned on the surface of the tongue portion 15 on the −Z direction side.

Figure 3:
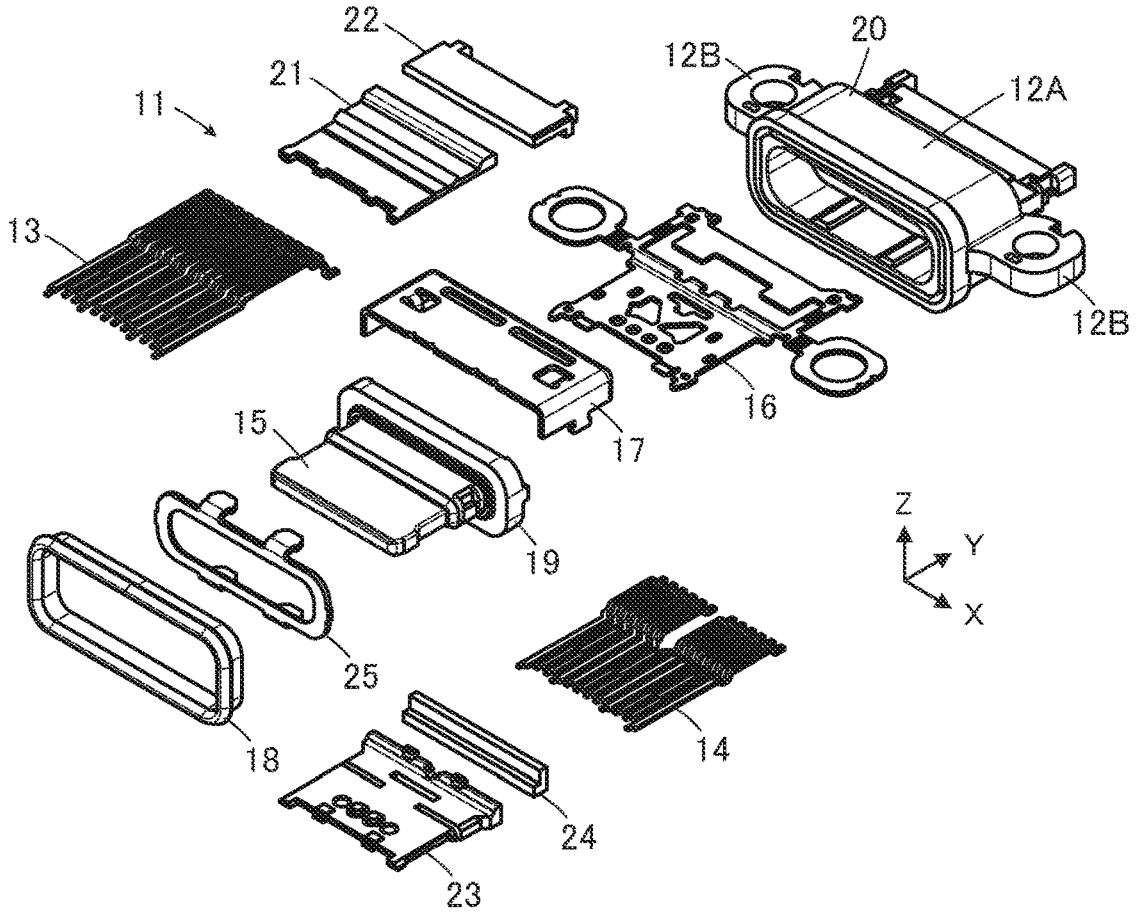
FIG. 3 is an exploded view of the waterproof connector according to the embodiment.

FIG. 3 shows an exploded view of the waterproof connector 11. The waterproof connector 11 includes the plurality of first contacts 13, the plurality of second contacts 14, the mid-plate 16, a first insulator 19 that forms the tongue portion 15 of the housing 12, a second insulator 20 that forms the tubular portion 12A and the pair of fixation portion 12B of the housing 12, the metal shell 17, and the waterproof member 18. The housing 12 is composed with the first insulator 19 and the second insulator 20.

The waterproof connector 11 further includes insulators 21 and 22 for modularizing the plurality of first contacts 13, insulators 23 and 24 for modularizing the plurality of second contacts 14, and an inner plate 25 to be fitted into the first insulator 19.

Figure 4:
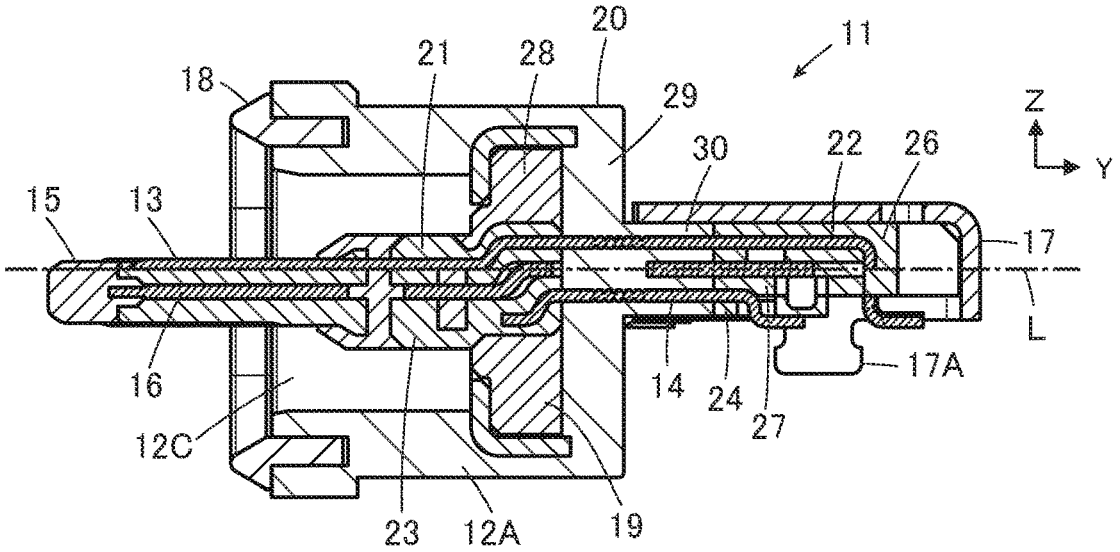
FIG. 4 is a side cross-sectional view of the waterproof connector according to the embodiment.

FIG. 4 shows a side cross-sectional view of the waterproof connector 11. Note that, in FIG. 4, the portion on the +Z direction side relative to a dashed line L extending in the Y direction indicates a cross section of the waterproof connector 11 cut along the YZ plane passing through the first contact 13, while the portion of the waterproof connector 11 on the −Z direction side relative to the dashed line L indicates a cross section of the waterproof connector 11 cut along the YZ plane passing through the second contact 14.

The first insulator 19 is molded in a state where the mid-plate 16 is clamped between a first module 26 in which the plurality of first contacts 13 are modularized by the insulators 21 and 22 and a second module 27 in which the plurality of second contacts 14 are modularized by the insulators 23 and 24. The first insulator 19 includes the tongue portion 15 and a flange portion 28 extending along the XZ plane at the end portion in the +Y direction of the tongue portion 15.

The inner plate 25 is fitted into the flange portion 28 of the first insulator 19. The inner plate 25, which is to be abutted by a mating connector (not shown) to be inserted into the mating connector receiving portion when fitting is performed, is made of metal or resin and is disposed on the face of the flange portion 28, on the −Y direction side, facing the mating connector receiving portion 12C.

The second insulator 20 is molded to cover the flange portion 28 of the first insulator 19 and the inner plate 25. The second insulator 20 includes the tubular portion 12A, a bottom plate portion 29 that closes the end portion in the +Y direction of the tubular portion 12A, and a flat plate portion 30 protruding from the bottom plate portion 29 toward the +Y direction side and extending along the XY plane.

The plurality of first contacts 13 and the plurality of second contacts 14, and the mid-plate 16 pass through the bottom plate portion 29 and the flat plate portion 30 of the second insulator 20 in the Y direction.

On the +Y direction side of the second insulator 20, the metal shell 17 is disposed to cover the end portions in the +Y direction of the first module 26 and the second module 27, where leg portions 17A of the metal shell 17 protrude in the −Z direction.

Figure 5:
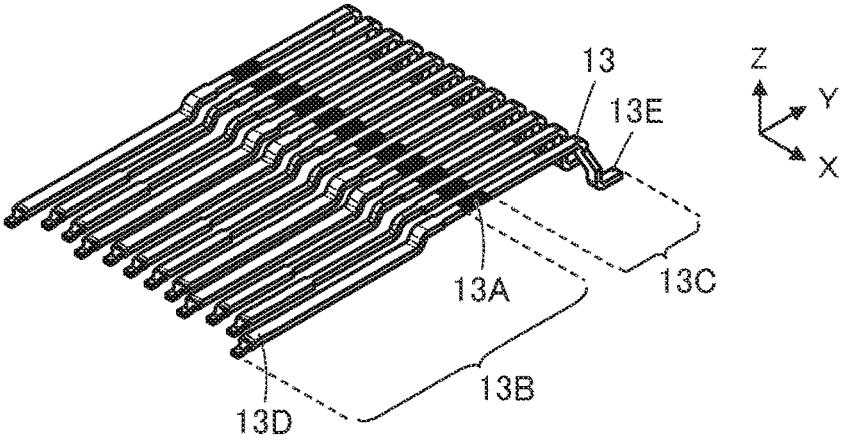
FIG. 5 is a perspective view showing a plurality of first contacts used for the waterproof connector according to the embodiment.

As shown in FIG. 5, the first contact 13, composed of a plate-like member extending in the Y direction, includes a contact-side waterproof shaped portion 13A formed at the middle portion in the Y direction and a contact front portion 13B located on the −Y direction side relative to the contact-side waterproof shaped portion 13A, and a contact back portion 13C located on the +Y direction side relative to the contact-side waterproof shaped portion 13A.

The contact-side waterproof shaped portion 13A is embedded in the second insulator 20 to block entry of water along the interface with the second insulator 20, and includes at least one groove or projection formed on the surface of the first contact 13 so as to surround and enclose the first contact 13. A contact portion 13D to be in contact with a contact of a mating connector (not shown) is formed at the end portion in the −Y direction of the contact front portion 13B and a connection portion 13E to be connected to a connection target object such as a substrate is formed at the end portion in the +Y direction of the contact back portion 13C.

Figure 6:
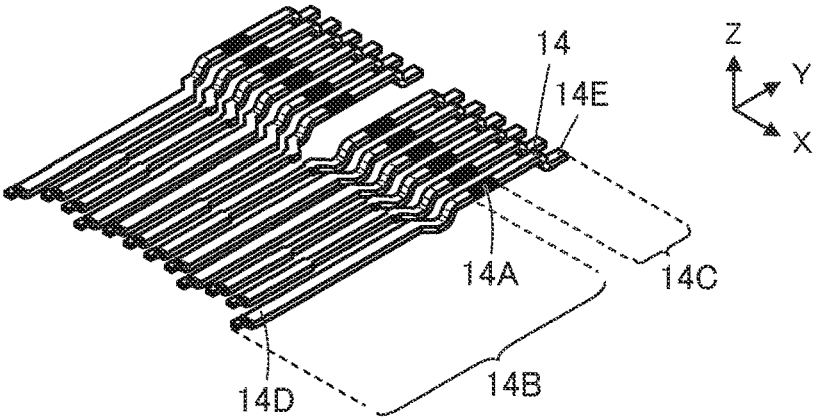
FIG. 6 is a perspective view showing a plurality of second contacts used for the waterproof connector according to the embodiment.

Similarly, as shown in FIG. 6, the second contact 14, composed of a plate-like member extending in the Y direction, includes a contact-side waterproof shaped portion 14A formed at the middle portion in the Y direction and a contact front portion 14B located on the −Y direction side relative to the contact-side waterproof shaped portion 14A, and a contact back portion 14C located on the +Y direction side relative to the contact-side waterproof shaped portion 14A.

The contact-side waterproof shaped portion 14A is embedded in the second insulator 20 to block entry of water along the interface with the second insulator 20, and includes at least one groove or projection formed on the surface of the second contact 14 so as to surround and enclose the second contact 14. A contact portion 14D to be in contact with a contact of the mating connector (not shown) is formed at the end portion in the −Y direction of the contact front portion 14B and a connection portion 14E to be connected to a connection target object such as a substrate is formed at the end portion in the +Y direction of the contact back portion 14C.

Next, a method of manufacturing a waterproof connector 11 according to an embodiment will be described.

Figure 7:
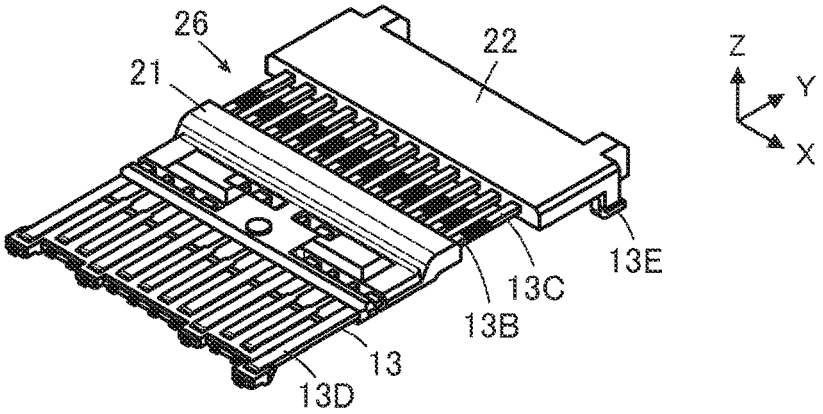
FIG. 7 is a perspective view showing a first module including the plurality of first contacts.

First, as shown in FIG. 7, an insulator 21 surrounding the contact front portions 13B of the plurality of first contacts 13 is molded with respective contact portions 13D being exposed, and an insulator 22 surrounding the contact back portions 13C of the plurality of first contacts 13 is molded with the respective connection portions 13E being exposed, to form the first module 26 in which the plurality of first contacts 13 are modularized.

Figure 8:
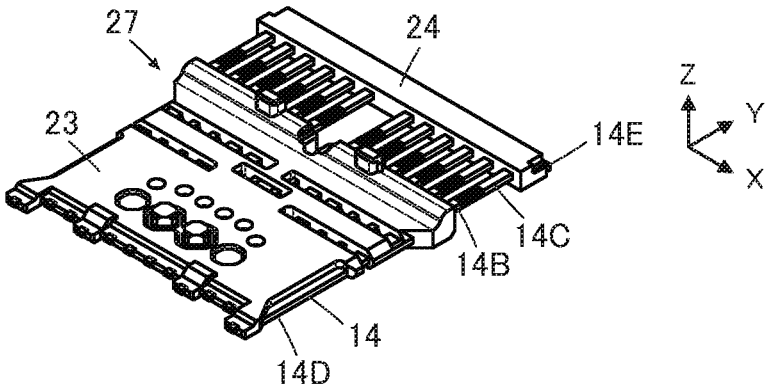
FIG. 8 is a perspective view showing a second module including the plurality of second contacts.

Similarly, as shown in FIG. 8, an insulator 23 surrounding the contact front portions 14B of the plurality of second contacts 14 is molded with respective contact portions 14D being exposed, and an insulator 24 surrounding the contact back portions 14C of the plurality of second contacts 14 is molded with the respective connection portions 14E being exposed, to form the second module 27 in which the plurality of second contacts 14 are modularized.

Figure 9:
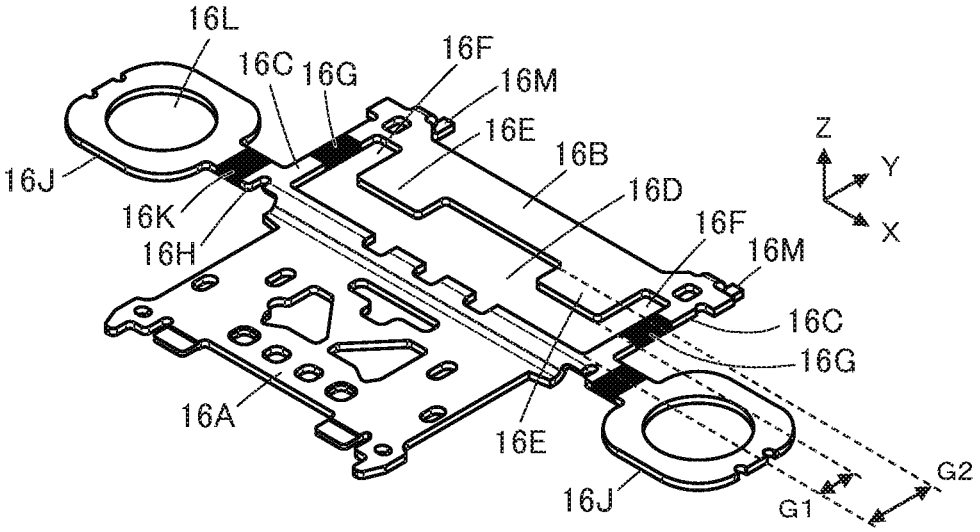
FIG. 9 is a perspective view showing a mid-plate used for the waterproof connector according to the embodiment.

As shown in FIG. 9, the mid-plate 16 clamped between the first module 26 and the second module 27 includes a front portion 16A in a flat plate-like shape, a rear portion 16B in a flat plate-like shape disposed apart from the front portion 16A in the +Y direction, and a pair of coupling portions 16C for coupling both end portions of the front portion 16A in the X direction with both end portions of the rear portion 16B in the X direction.

Between the front portion 16A and the rear portion 16B, a gap 16D is formed. A pair of protrusions 16E protruding, inside the gap 16D, toward the front portion 16A in the −Y direction are formed at both end portions of the rear portion 16B in the X direction, respectively, and a length G1 along the Y direction of the gap 16D at both end portions in the X direction of the rear portion 16B is set to be less than a length G2 along the Y direction of the gap 16D at the center portion in the X direction of the rear portion 16B. That is, due to the existence of the pair of protrusions 16E, portions of the gap 16D having a relatively short length and a relatively long length along the Y direction are formed in accordance with the positions in the X direction.

A pair of cutouts 16F extending in the Y direction is formed between the pair of protrusions 16E and the pair of coupling portions 16C.

The pair of coupling portions 16C each have a mid-plate-side waterproof shaped portion 16G. The mid-plate-side waterproof shaped portion 16G is embedded in the second insulator 20 to block entry of water along the interface with the second insulator 20, and includes at least one groove or projection formed on the surface of the coupling portion 16C so as to surround and enclose the coupling portions 16C. The mid-plate-side waterproof shaped portion 16G and the cutout 16F are arranged at positions at least partially overlapping with each other in the Y direction.

In addition, protrusions 16J having a substantially rectangular flat plate shape is coupled to each of the end portions in the −Y direction of the pair of coupling portions 16C via an arm portion 16H extending outward in the X direction. The arm portion 16H has a mid-plate-side waterproof shaped portion 16K similar to the mid-plate-side waterproof shaped portion 16G of the coupling portion 16C. Further, an opening 16L is formed through the center of the protrusion 16J.

Furthermore, a mid-plate-side connection portion 16M is formed at each of both end portions of the rear portion 16B in the X direction, the mid-plate-side connection portion 16M being to be connected to a connection target object such as a substrate.

Figure 10:
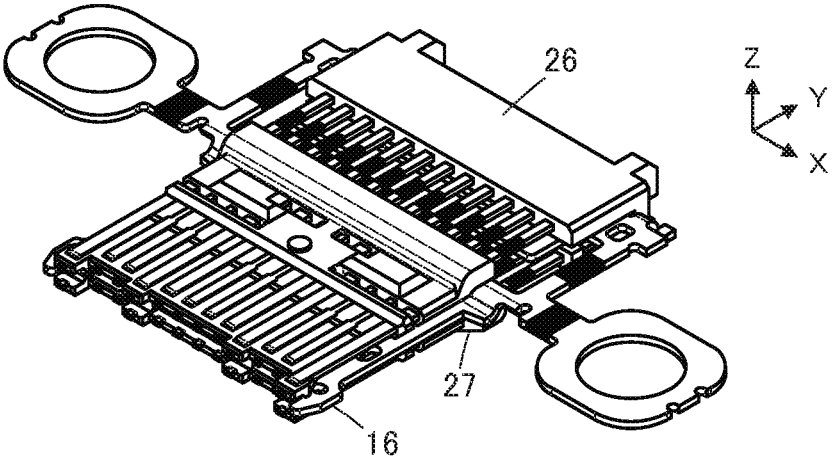
FIG. 10 is a perspective view showing that the mid-plate is clamped between the first module and the second module.

As shown in FIG. 10, the first module 26 is disposed on the +Z direction side of the mid-plate 16 and the second module 27 is disposed on the −Z direction side of the mid-plate 16 with the mid-plate 16 thus formed interposed in between. Although not shown, the front portion 16A of the mid-plate 16 faces the contact front portions 13B of the plurality of first contacts 13 of the first module 26 and the contact front portions 14B of the plurality of second contacts 14 of the second module 27, while the rear portion 16B of the mid-plate 16 faces the contact back portions 13C of the plurality of first contacts 13 of the first module 26 and the contact back portions 14C of the plurality of second contacts 14 of the second module 27. The contact-side waterproof shaped portions 13A of the plurality of first contacts 13 of the first module 26 and the contact-side waterproof shaped portions 14A of the plurality of second contacts 14 of the second module 27 are disposed at positions corresponding to the gap 16D of the mid-plate 16.

Figure 11:
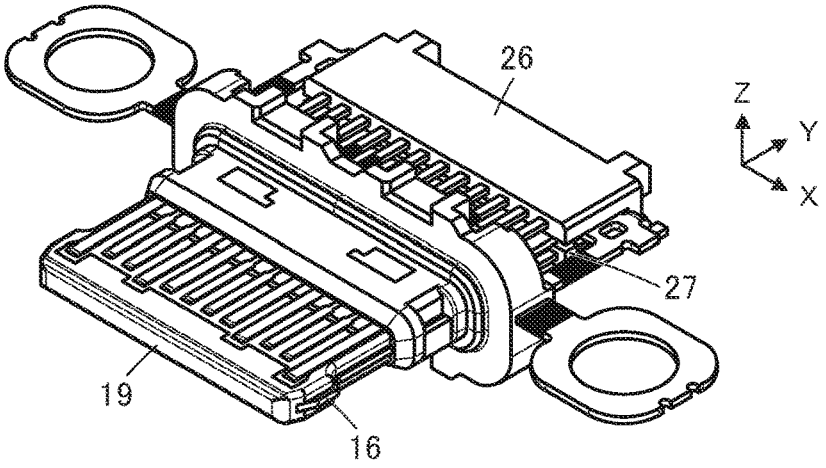
FIG. 11 is a perspective view showing that a first insulator is molded.

As shown in FIG. 11, the first insulator 19 is molded in a state where the mid-plate 16 is clamped between the first module 26 and the second module 27. The first insulator 19 is molded to thus integrate the mid-plate 16, the first module 26, and the second module 27 with one another.

Figure 12:
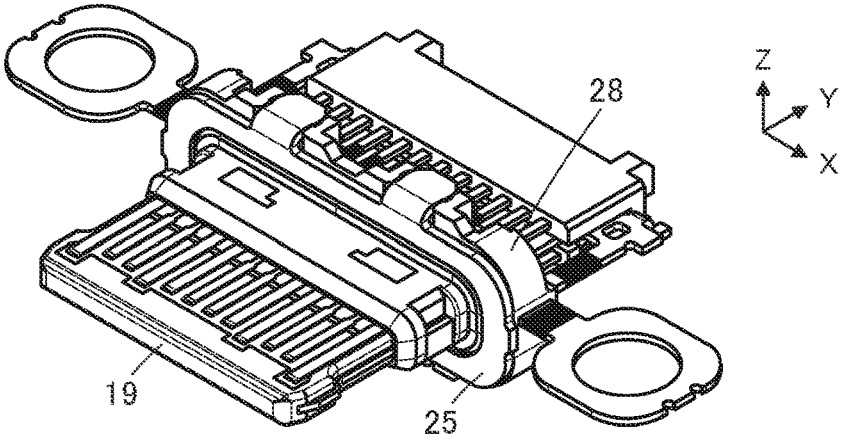
FIG. 12 is a perspective view showing that an inner plate is fitted into the first insulator.
Figure 13:
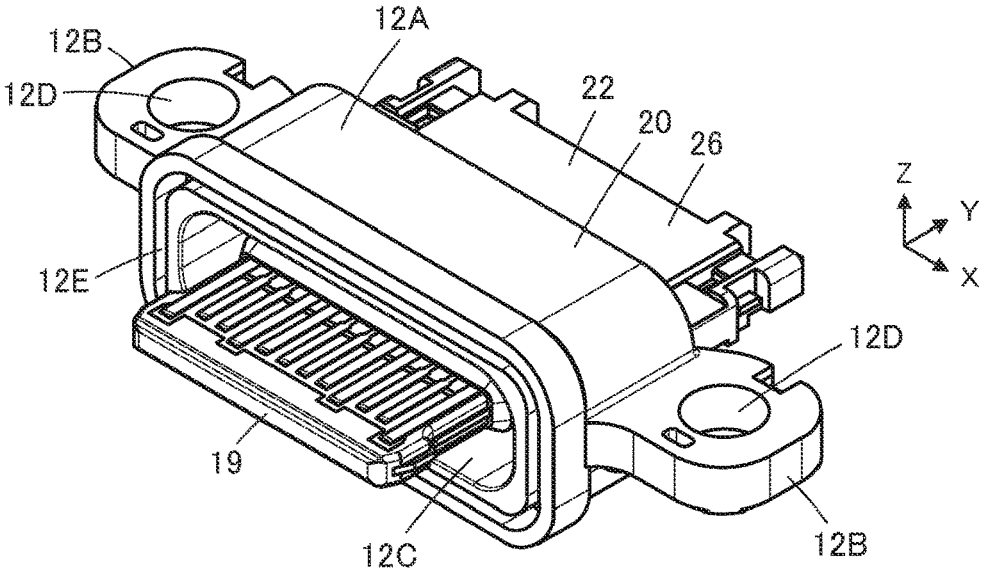
FIG. 13 is a perspective view showing that a second insulator is molded.

Further, as shown in FIG. 12, the inner plate 25 is fitted into the flange portion 28 of the first insulator 19 from the −Y direction side, where under this state, the second insulator 20 is molded as shown in FIG. 13. The second insulator 20 forms a tubular portion 12A including a mating connector receiving portion 12C therein and a pair of fixation portions 12B protruding from both end portions of the tubular portion 12A in the X direction.

Although not shown, the protrusion 16J of the mid-plate 16 is covered with the fixation portion 12B. The fixation portion 12B includes a through hole 12D passing therethrough in the Z direction, where the opening 16L of the protrusion 16J of the mid-plate 16 corresponds to the through hole 12D of the fixation portion 12B.

In addition, a groove 12E surrounding the end portion in the −Y direction of the mating connector receiving portion 12C is formed at the end portion in the −Y direction of the tubular portion 12A.

The metal shell 17 is disposed on the surface on the +Z direction side of the insulator 22 of the first module 26 protruding to the +Y direction side of the second insulator 20 to be exposed, and the waterproof member 18 is mounted into the groove 12E at the end portion in the −Y direction of the tubular portion 12A, to thus complete manufacturing of the waterproof connector 11 shown in FIGS. 1 and 2.

Note that, as shown in FIG. 2, at the end portion in the +Y direction of the waterproof connector 11, connection portions 13E of the plurality of first contacts 13, connection portions 14E of the plurality of second contacts 14, a pair of mid-plate-side connection portions 16M of the mid-plate 16, and the pair of leg portions 17A of the metal shell 17 is exposed and protrude in the −Z direction.

Figure 14:
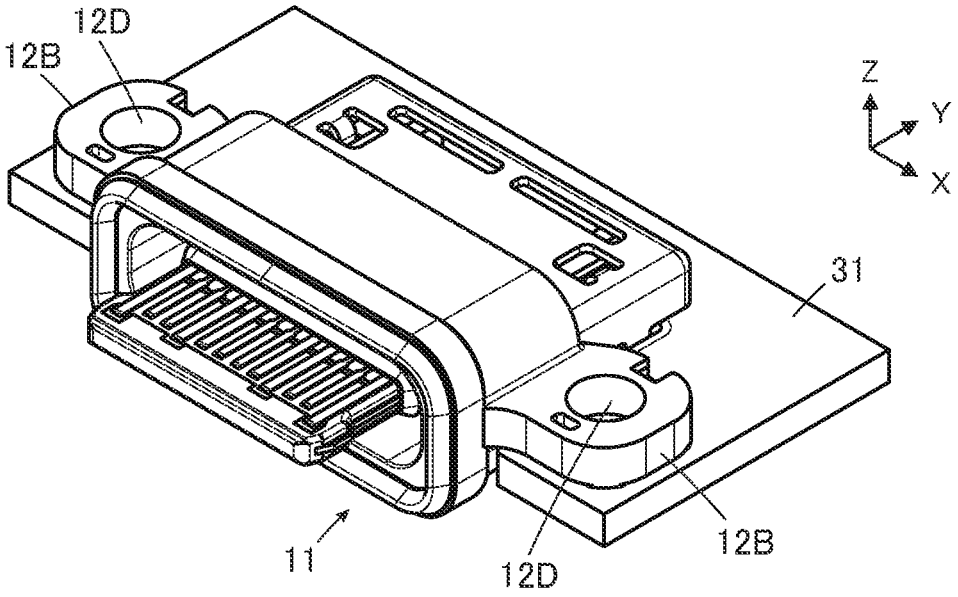
FIG. 14 is a perspective view showing the waterproof connector according to the embodiment mounted on a substrate.

FIG. 14 is a perspective view showing the waterproof connector 11 mounted on a substrate 31 being a connection target object. The waterproof connector 11 may be fixed on the substrate 31 by passing fixing screws (not shown) through the through holes 12D of the pair of fixation portions 12B.

The connection portions 13E of the plurality of first contacts 13 and the connection portions 14E of the plurality of second contacts 14, each protruding in the −Z direction from the end portion in the +Y direction of the waterproof connector 11, are each connected to connection pads (not shown) of the substrate 31. The pair of mid-plate-side connection portions 16M of the mid-plate 16 and the pair of leg portions 17A of the metal shell 17, each protruding in the −Z direction from the end portion in the +Y direction of the waterproof connector 11 are connected to a ground line (not shown) of the substrate 31, and the mid-plate 16 and the metal shell 17 are set at the ground potential.

Note that, in a case where the second insulator 20 is molded such that the protrusion 16J of the mid-plate 16 is exposed to the −Z direction side of the fixation portion 12B, the waterproof connector 11 is fixed on the substrate 31 using fixing screws (not shown), whereby the protrusion 16J of the mid-plate 16 is connected to a ground pad (not shown) of the substrate 31, thus allowing the mid-plate 16 to be set at the ground potential as well.

Figure 15:
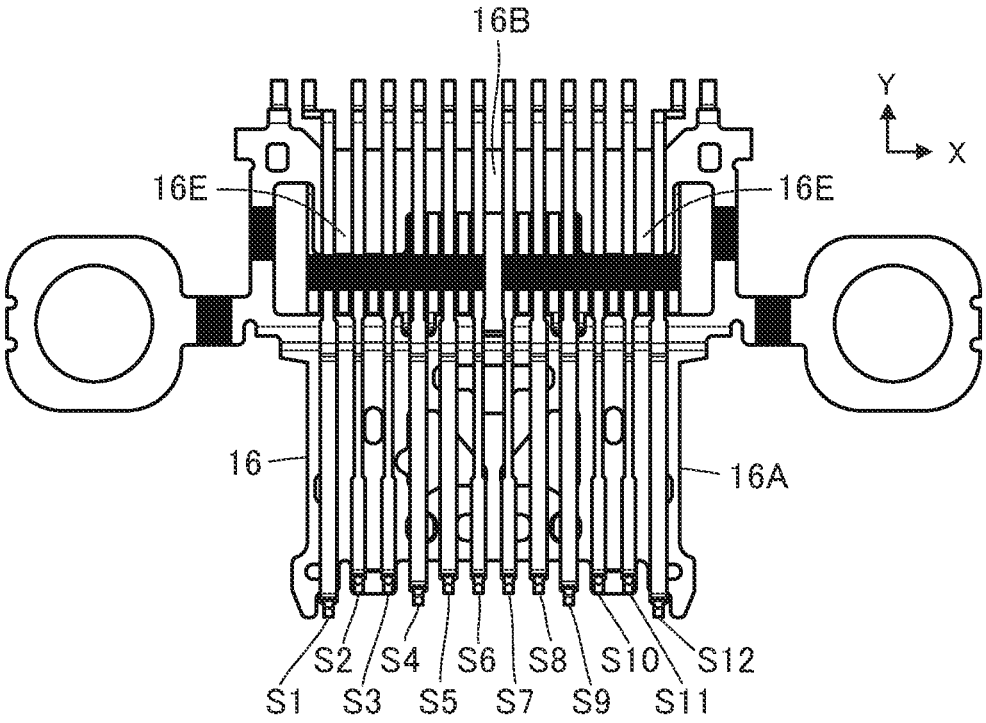
FIG. 15 is a plan view showing a positional relationship between the plurality of first contacts and the mid-plate.
Figure 16:
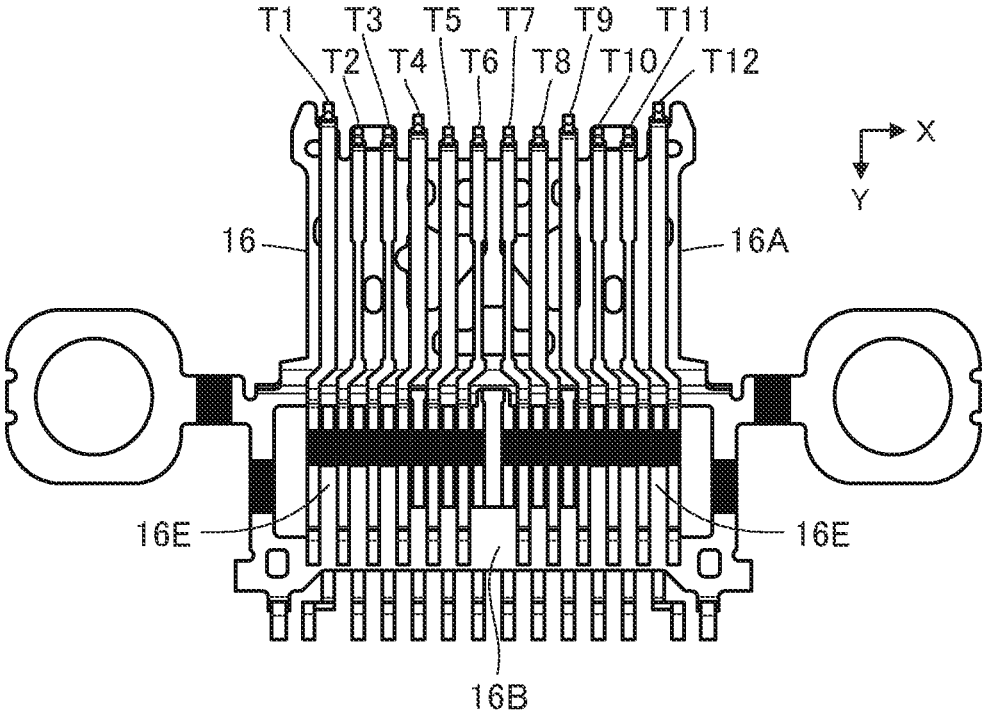
FIG. 16 is a bottom view showing a positional relationship between the plurality of second contacts and the mid-plate.

FIGS. 15 and 16 show the positional relationship between the plurality of first contacts 13 and the plurality of second contacts 14, and the mid-plate 16. That is, FIGS. 15 and 16 are a plan view and a bottom view showing a state where all members excluding the plurality of first contacts 13, the plurality of second contacts 14, and the mid-plate 16 are removed from the waterproof connector 11.

The plurality of first contacts 13 include twelve contacts S1 to S12 each extending in the Y direction and being aligned from the −X direction to the +X direction. Among these contacts, the contacts S1 and S12 located at the outermost sides in the X direction serve as ground contacts, and two contacts S2 and S3 adjacent to the contact S1 and two contacts S11 and S10 adjacent to the contact S12 are each used for contacts for high-speed signal transmission and the contacts S6 and S7 located at the center portion in the X direction are used for contacts for low-speed signal transmission. The other contacts S4, S5, S8, and S9 serve as contacts used for power supply, or contacts used for detecting insertion and extraction of the waterproof connector 11 and the like.

Similarly, the plurality of second contacts 14 include twelve contacts T1 to T12 each extending in the Y direction and being aligned from the −X direction to the +X direction. Among these contacts, the contacts T1 and T12 located at the outermost side in the X direction serve as ground contacts, and two contacts T2 and T3 adjacent to the contact T1 and two contacts T11 and T10 adjacent to the contact T12 are each used for contacts for high-speed signal transmission and the contacts T6 and T7 located at the center portion in the X direction are used for contacts for low-speed signal transmission. The other contacts T4, T5, T8, and T9 serve as contacts used for power supply, or contacts used for detecting insertion and extraction of the waterproof connector 11 and the like.

The pair of protrusions 16E arranged at both end portions in the X direction of the rear portion 16B of the mid-plate 16 face the contacts S1 to S3 and the contacts S10 to S12 arranged at both end portions in the X direction among the plurality of first contacts 13, and the contacts T1 to T3 and the contacts T10 to T12 arranged at both ends of the plurality of second contacts 14 in the X direction among the plurality of second contacts 14, and do not face the contacts S4 to S9 arranged at the center portion in the X direction among the plurality of first contacts 13, and the contacts T4 to T9 arranged at the center portion in the X direction among the plurality of second contacts 14.

That is, a portion of the gap 16D of the mid-plate 16 facing the contacts S4 to S9 and T4 to T9 (the other part of contacts) that do not include contacts for high-speed signal transmission have no protrusions 16E and thus have the length G2 along the Y direction, while a portion of the gap 16D of the mid-plate 16 facing the contacts S1 to S3, S10 to S12, T1 to T3, and T10 to T12 (one part of contacts) including contacts for high-speed signal transmission have the length G1 that is less than the length G2 by the protrusion 16E along the Y direction.

In this way, the mid-plate 16 faces the contacts S1 to S3, S10 to S12, T1 to T3, and T10 to T12 including contacts for high-speed signal transmission over a range in the Y direction being longer than the other part of contacts, and even if high-speed signals are passed through contacts for high-speed signal transmission constituted by the contacts S2, S3, S11, S10, T2, T3, T11, and T10, crosstalk can be minimized to allow a transmission of high reliance to be performed.

Figure 17:
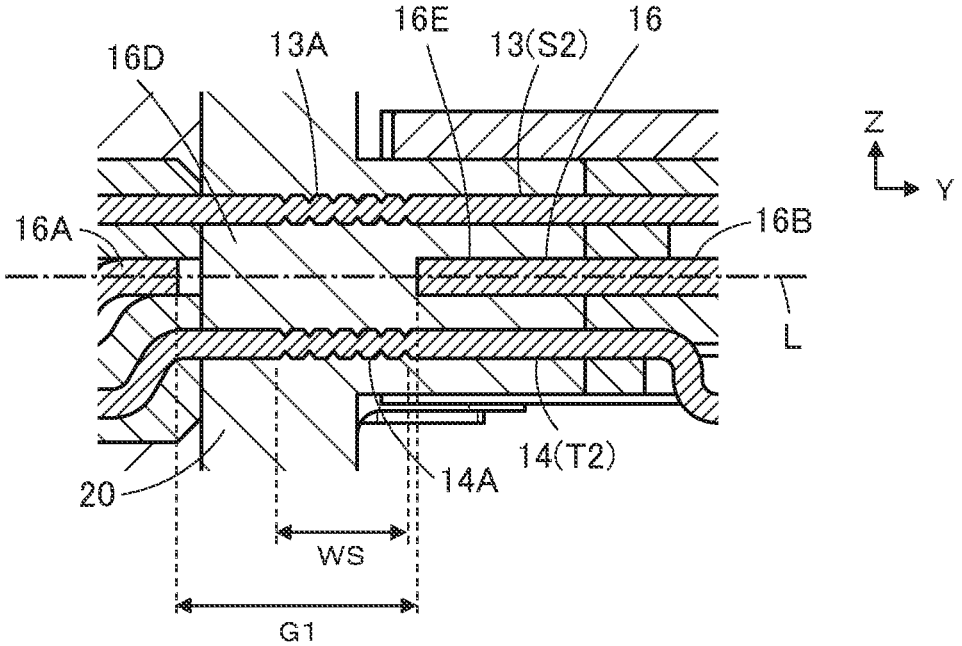
FIG. 17 is an enlarged view of a principle part of FIG. 4.

As shown in FIG. 17, although the protrusion 16E of the mid-plate 16 faces, for example, the contacts S2 and T2 being contacts for high-speed signal transmission, the contact-side waterproof shaped portion 13A of the contact S2 and the contact-side waterproof shaped portion 14A of the contact T2 are arranged at positions corresponding to the gap 16D of the mid-plate 16. Note that, in FIG. 17, similarly to FIG. 4, the portion on the +Z direction side relative to a dashed line L extending in the Y direction indicates a cross section of the waterproof connector 11 cut along the YZ plane passing through the contact S2, while the portion on the −Z direction side relative to the dashed line L indicates a cross section of the waterproof connector 11 cut along the YZ plane passing through the contact T2.

Similarly, as for the contacts S4 to S9 and T4 to T9 that do not include contacts for high-speed signal transmission contact as well, the contact-side waterproof shaped portions 13A and 14A are arranged at positions corresponding to the gap 16D of the mid-plate 16.

Thus, a resin of sufficient thickness composing the second insulator 20 is ensured around the contact-side waterproof shaped portions 13A and 14A without having an influence from the mid-plate 16 and without increasing the height of the waterproof connector 11 in the Z direction. This provides high contractive force of resin when molding the second insulator 20 to achieve excellent waterproofness.

In addition, excellent waterproofness is achieved by molding the second insulator 20, eliminating a potting process to facilitate the manufacture of the waterproof connector 11.

In particular, the contact-side waterproof shaped portions 13A and 14A includes at least one groove or projection formed on the surfaces of the first contact 13 and the second contact 14 so as to surround and enclose the first contact 13 and the second contact 14, to thus efficiently block entry of water along the interface with the second insulator 20.

Note that, although the mid-plate-side connection portion 16M of the mid-plate 16 is exposed from the end portion in the +Y direction of the waterproof connector 11, the mid-plate-side waterproof shaped portion 16G of the coupling portion 16C is embedded in the second insulator 20, to thus block entry of water along the interface between the coupling portion 16C and the second insulator 20.

Similarly, the pair of arm portions 16H of the mid-plate 16 each have the mid-plate-side waterproof shaped portion 16K as well, thus, even if at least a part of the protrusion 16J is exposed from the fixation portion 12B of the second insulator 20, the mid-plate-side waterproof shaped portion 16K is embedded in the second insulator 20, thus blocking entry of water along the interface between the arm portion 16H and the second insulator 20.

Accordingly, water is prevented from entering the substrate 31 side through the interior portion of the mating connector receiving portion 12C of the second insulator 20.

Figure 18:
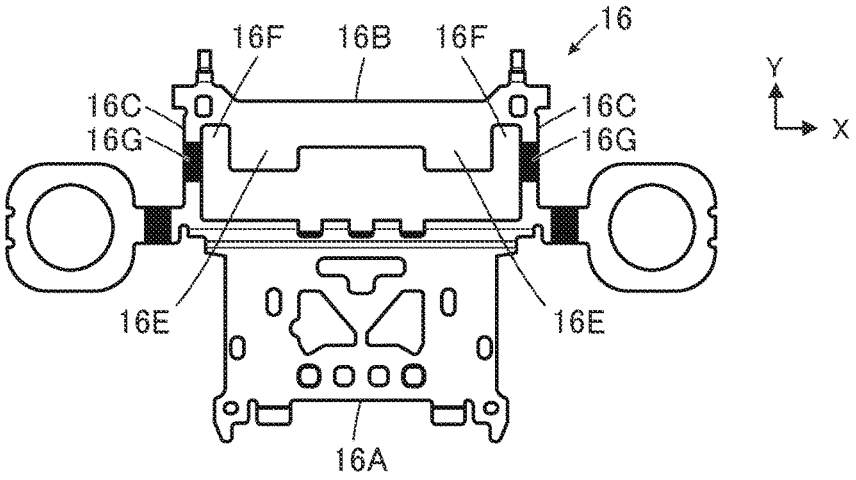
FIG. 18 is a plan view showing the mid-plate used for the waterproof connector according to the embodiment.

Note that the waterproof connector 11 according to the above embodiment, as shown in FIG. 18, includes, but not limited to, the pair of protrusions 16E protruding toward the front portion 16A at both end portions of the rear portion 16B of the mid-plate 16 in the X direction.

Figure 19:
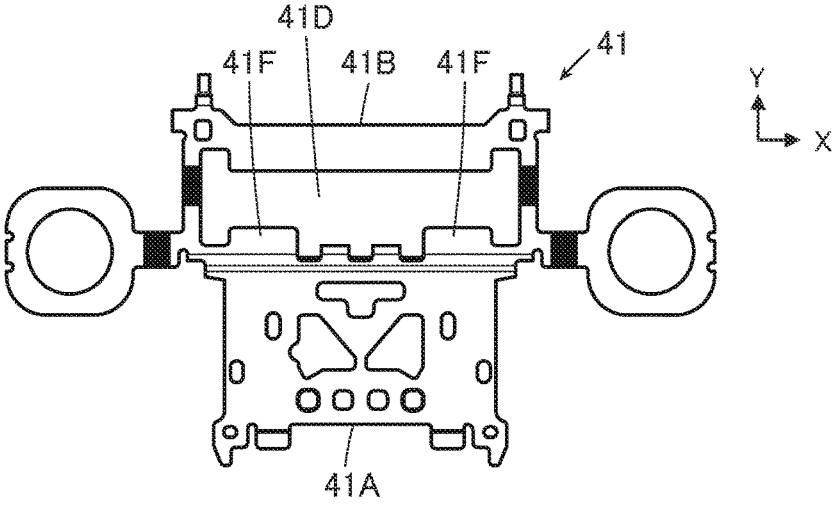
FIG. 19 is a plan view showing a mid-plate used for a waterproof connector according to a first modified example.

For example, even if, as in a mid-plate 41 shown in FIG. 19, a pair of protrusions 41F protrude from both end portions of a front portion 41A in the X direction toward a rear portion 41B, the length along the Y direction of a gap 41D at both end portions in the X direction becomes less than the length along the Y direction of the gap 41D at the center portion in the X direction, and even if a high-speed signal is passed through the contacts S2, S3, S11, S10, T2, T3, T11, and T10 arranged on the both end sides in the X direction among the plurality of first contacts 13 and the plurality of second contacts 14, crosstalk can be minimized to allow a transmission of high reliance to be performed.

Figure 20:
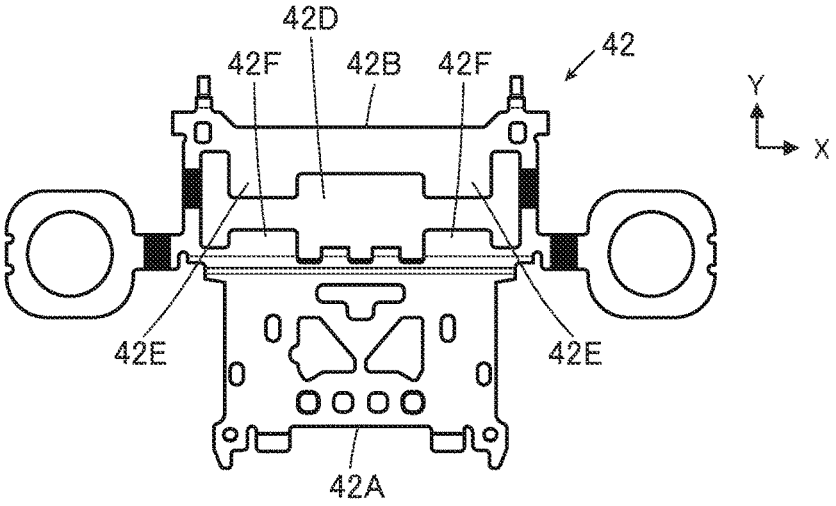
FIG. 20 is a plan view showing a mid-plate used for a waterproof connector according to a second modified example.

Also, even if, as in a mid-plate 42 shown in FIG. 20, a pair of protrusions 42E protrude from both end portions of a rear portion 42B in the X direction toward a front portion 42A and a pair of protrusions 42F protrude from both end portions of the front portion 42A in the X direction toward the rear portion 42B, the length along the Y direction of a gap 42D at the both end portions in the X direction becomes less than the length along the Y direction of the gap 42D at the center portion in the X direction, and thus the same advantage as in the waterproof connector 11 according to the embodiment can be provided.

As shown in FIG. 18, the waterproof connector 11 according to the above-described embodiment includes, but is not limited to, the pair of cutouts 16F extending along the Y direction between the pair of protrusions 16E and the pair of coupling portions 16C of the mid-plate 16.

Figure 21:
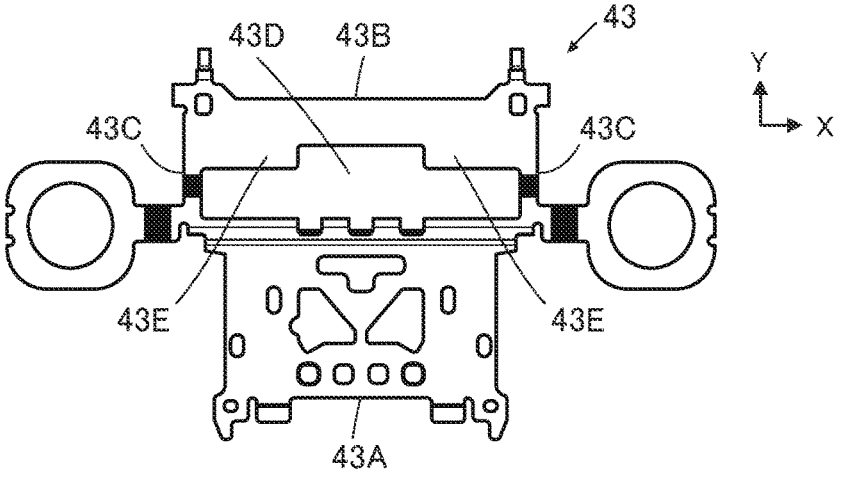
FIG. 21 is a plan view showing a mid-plate used for a waterproof connector according to a third modified example.

For example, as in a mid-plate 43 shown in FIG. 21, a pair of protrusions 43E protruding from both end portions of a rear portion 43B in the X direction toward a front portion 43A are connected, without having cutouts, to a coupling portion 43C, the same advantage as in the waterproof connector 11 according to the embodiment can be provided. However, provided that the cutout 16F is provided as in the mid-plate 16 shown in FIG. 18, a long length in the Y direction of the mid-plate-side waterproof shaped portion 16G formed in the coupling portion 16C can be ensured, allowing the waterproofness to be more reliably improved.

Figure 22:
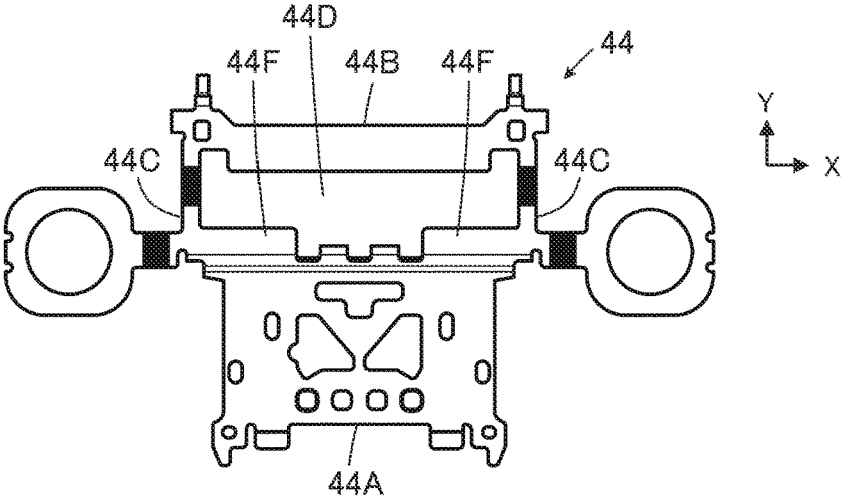
FIG. 22 is a plan view showing a mid-plate used for a waterproof connector according to a fourth modified example.

Also, as in a mid-plate 44 shown in FIG. 22, a pair of protrusions 44F protruding from both end portions of a front portion 44A in the X direction toward a rear portion 44B are connected, without having cutouts, to a coupling portion 44C, the same advantage as in the waterproof connector 11 according to the embodiment can be provided.

Figure 23:
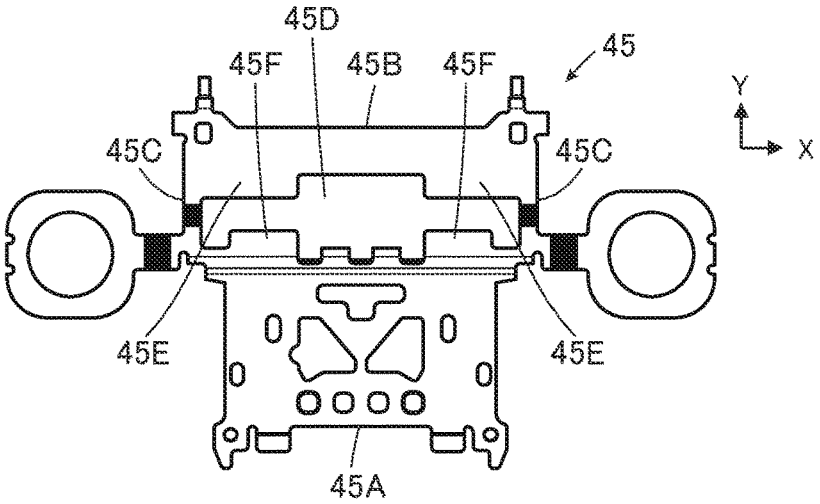
FIG. 23 is a plan view showing a mid-plate used for a waterproof connector according to a fifth modified example.

Similarly, as in a mid-plate 45 shown in FIG. 23, a pair of protrusions 45E may protrude from both end portions of a rear portion 45B in the X direction toward a front portion 45A and a pair of protrusions 45F may protrude from both end portions of the front portion 45A in the X direction toward the rear portion 45B, and the pair of protrusions 45E protruding from the rear portion 45B may be connected to a coupling portion 45C without having cutouts.

Figure 24:
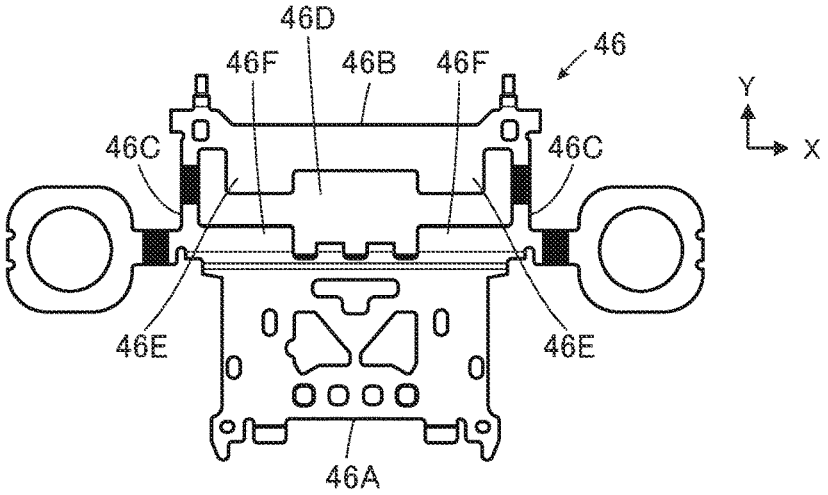
FIG. 24 is a plan view showing a mid-plate used for a waterproof connector according to a sixth modified example.

Also, as in a mid-plate 46 shown in FIG. 24, a pair of protrusions 46E may protrude from both end portions of a rear portion 46B in the X direction toward a front portion 46A and a pair of protrusions 46F may protrude from both end portions of the front portion 46A in the X direction toward the rear portion 46B, and the pair of protrusions 46F protruding from the front portion 46A may be connected to a coupling portion 46C without having cutouts.

Figure 25:
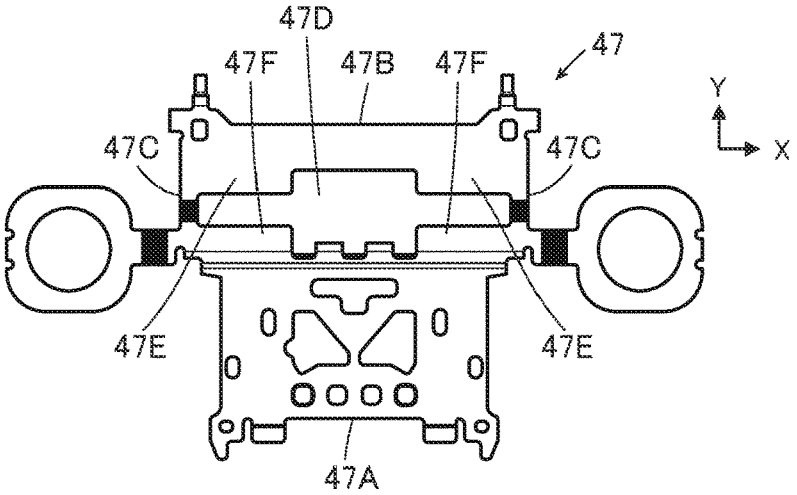
FIG. 25 is a plan view showing a mid-plate used for a waterproof connector according to a seventh modified example.
Figure 26:
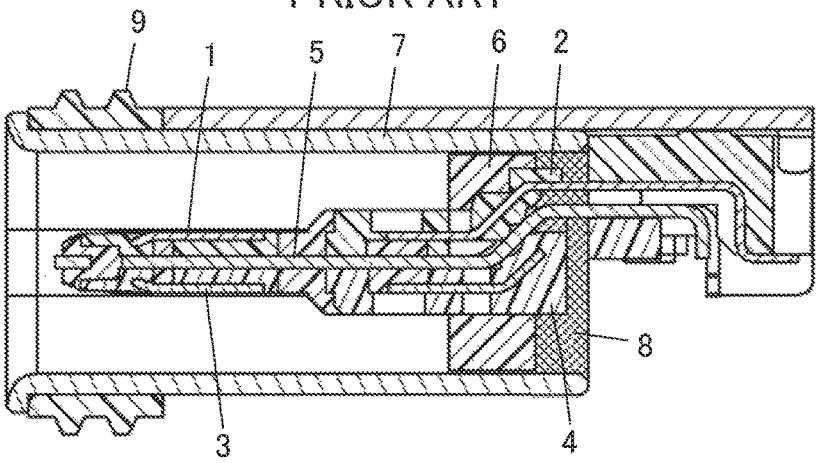
FIG. 26 PRIOR ART
FIG. 26 is a side cross-sectional view showing a conventional connector.

Further, as in a mid-plate 47 shown in FIG. 25, a pair of protrusions 47E may protrude from both end portions of a rear portion 47B in the X direction toward a front portion 47A and a pair of protrusions 47F may protrude from both end portions of the front portion 47A in the X direction toward the rear portion 47B, and both the pair of protrusions 47E and the pair of protrusions 47F may be connected to a coupling portion 47C without having cutouts.

In the above-described embodiments, although the plurality of first contacts 13 and the plurality of second contacts 14 are aligned in two rows so as to face both surfaces of the mid-plate 16 respectively, the invention is not limited thereto and may also be applied to a waterproof connector in which a plurality of contacts are aligned in a single row.

In addition, the number of contacts is not limited as long as it suffices to include two or more contacts.

What is claimed is:

1. A waterproof connector comprising:

a plurality of contacts each extending in a fitting direction, the plurality of contacts being aligned;

a housing configured to hold the plurality of contacts; and a mid-plate made of metal arranged to face the plurality of contacts, wherein the plurality of contacts each include a contact-side waterproof shaped portion located at a middle portion in the fitting direction and embedded in the housing to block entry of water along the interface with the housing, a contact front portion located in front of the contact-side waterproof shaped portion in the fitting direction and having a contact portion to be in contact with a contact of a mating connector, and a contact back portion located behind the contact-side waterproof shaped portion in the fitting direction and having a connection portion to be connected to a connection target object, wherein the contact-side waterproof shaped portion includes at least one groove or projection formed on a surface of the contact so as to surround and enclose the contact, wherein the mid-plate includes a front portion in a flat plate-like shape facing the contact front portion of each of the plurality of contacts, a rear portion in a flat plate-like shape facing the contact back portion of each of the plurality of contacts, and at least one coupling portion for coupling the front portion and the rear portion with each other such that a gap is formed between the front portion and the rear portion, each of the at least one coupling portion having a mid-plate-side waterproof shaped portion embedded in the housing to block entry of water along an interface with the housing, wherein the mid-plate-side waterproof shaped portion includes at least one groove or projection formed on a surface of the coupling portion so as to surround and enclose the coupling portion, wherein a length in the fitting direction of a portion of the gap facing a subset of contacts among the plurality of contacts and a length in the fitting direction of another portion of the gap facing other contacts differ from each other, and wherein the contact-side waterproof shaped portion of each of the plurality of contacts is disposed, in the fitting direction, at a position corresponding to the gap of the mid-plate.

2. The waterproof connector according to claim 1, wherein the plurality of contacts includes a plurality of first contacts and a plurality of second contacts that are aligned to face both surfaces of the mid-plate respectively with the mid-plate interposed therebetween.

3. The waterproof connector according to claim 1, wherein the subset of contacts includes a contact for high-speed signal transmission, wherein the other contacts are contacts excluding the contact for high-speed signal transmission, and wherein the length in the fitting direction of the portion of the gap facing the subset of contacts is less than the length in the fitting direction of the portion of the gap facing the other contacts.

4. The waterproof connector according to claim 3, wherein the subset of contacts are arranged on both sides of the other contacts in an alignment direction of the plurality of contacts.

5. The waterproof connector according to claim 4, wherein the rear portion of the mid-plate includes, corresponding to the subset of contacts, a pair of protrusions being along the fitting direction and protruding toward the front portion on both sides in the alignment direction of the plurality of contacts.

6. The waterproof connector according to claim 4, wherein the front portion of the mid-plate includes, corresponding to the subset of contacts, a pair of protrusions being along the fitting direction and protruding toward the rear portion on both sides in the alignment direction of the plurality of contacts.

7. The waterproof connector according to claim 5, wherein the mid-plate includes a pair of the coupling portions arranged on both sides in the alignment direction of the plurality of contacts, and a pair of cutouts formed between the pair of protrusions and the pair of coupling portions, and wherein the mid-plate-side waterproof shaped portion of each of the pair of coupling portions and each of the cutouts are disposed at positions at least partially overlapping with each other in the fitting direction.

8. The waterproof connector according to claim 5, wherein the mid-plate includes a pair of the coupling portions arranged on both sides in the alignment direction of the plurality of contacts, and wherein the pair of protrusions are connected to the pair of coupling portions, respectively.

9. The waterproof connector according to claim 1, wherein the housing includes a mating connector receiving portion opening forward in the fitting direction, and wherein the contact portions of the plurality of contacts are exposed at least in the mating connector receiving portion.

10. The waterproof connector according to claim 9, wherein the housing includes:

a first insulator covering the contact front portions of the plurality of contacts and the front portion of the mid-plate so as to expose the contact portions of the plurality of contacts; and a second insulator covering the contact-side waterproof shaped portions and the contact back portions of the plurality of contacts, the coupling portion and the rear portion of the mid-plate, and a back portion of the first insulator so as to expose the connection portions of the plurality of contacts, and wherein the second insulator forms the mating connector receiving portion, and the first insulator seals a bottom portion of the mating connector receiving portion.

11. The waterproof connector according to claim 9, further comprising a metal shell attached to a back portion of the housing and covering the connection portions of the plurality of contacts.

12. The waterproof connector according to claim 9, further comprising a seamless waterproof member surrounding a front end portion of the mating connector receiving portion disposed at a front end portion of the housing in the fitting direction.

13. The waterproof connector according to claim 9, further comprising an inner plate disposed at a bottom portion of the mating connector receiving portion and to be abutted by the mating connector received in the mating connector receiving portion when fitted to the mating connector.

14. The waterproof connector according to claim 1,
wherein the housing includes a pair of fixation portions protruding to both sides of the plurality of contacts in an alignment direction, the housing being fixed to the connection target object via the pair of fixation portions.

15. The waterproof connector according to claim 14,
wherein the mid-plate includes a pair of protrusions protruding to both sides of the plurality of contacts in the alignment direction and being covered with the pair of fixation portions of the housing.

16. A waterproof connector comprising:
a plurality of contacts each extending in a fitting direction, the plurality of contacts being aligned;
a housing configured to hold the plurality of contacts; and
a mid-plate made of metal arranged to face the plurality of contacts,
wherein the plurality of contacts each include a contact-side waterproof shaped portion located at a middle portion in the fitting direction and embedded in the housing to block entry of water along the interface with the housing, a contact front portion located in front of the contact-side waterproof shaped portion in the fitting direction and having a contact portion to be in contact with a contact of a mating connector, and a contact back portion located behind the contact-side waterproof shaped portion in the fitting direction and having a connection portion to be connected to a connection target object,
wherein the contact-side waterproof shaped portion includes at least one groove or projection formed on a surface of the contact so as to surround and enclose the contact,
wherein the mid-plate includes a front portion in a flat plate-like shape facing the contact front portion of each of the plurality of contacts, a rear portion in a flat plate-like shape facing the contact back portion of each of the plurality of contacts, and at least one coupling portion for coupling the front portion and the rear portion with each other such that a gap is formed between the front portion and the rear portion, each of the at least one coupling portion having a mid-plate-side waterproof shaped portion embedded in the housing to block entry of water along an interface with the housing,
wherein the mid-plate-side waterproof shaped portion includes at least one groove or projection formed on a surface of the coupling portion so as to surround and enclose the coupling portion,
wherein a length in the fitting direction of a portion of the gap facing a subset of contacts among the plurality of contacts and a length in the fitting direction of another portion of the gap facing other contacts differ from each other,
wherein the subset of contacts includes a contact for high-speed signal transmission,
wherein the other contacts are contacts excluding the contact for high-speed signal transmission, and
wherein the length in the fitting direction of the portion of the gap facing the subset of contacts is less than the length in the fitting direction of the portion of the gap facing the other contacts.

17. The waterproof connector according to claim 16,
wherein the plurality of contacts includes a plurality of first contacts and a plurality of second contacts that are aligned to face both surfaces of the mid-plate respectively with the mid-plate interposed therebetween.

18. The waterproof connector according to claim 16,
wherein the subset of contacts are arranged on both sides of the other contacts in an alignment direction of the plurality of contacts.

19. The waterproof connector according to claim 18,
wherein the rear portion of the mid-plate includes, corresponding to the subset of contacts, a pair of protrusions being along the fitting direction and protruding toward the front portion on both sides in the alignment direction of the plurality of contacts.

20. The waterproof connector according to claim 18,
wherein the front portion of the mid-plate includes, corresponding to the subset of contacts, a pair of protrusions being along the fitting direction and protruding toward the rear portion on both sides in the alignment direction of the plurality of contacts.

21. The waterproof connector according to claim 19,
wherein the mid-plate includes a pair of the coupling portions arranged on both sides in the alignment direction of the plurality of contacts, and a pair of cutouts formed between the pair of protrusions and the pair of coupling portions, and
wherein the mid-plate-side waterproof shaped portion of each of the pair of coupling portions and each of the cutouts are disposed at positions at least partially overlapping with each other in the fitting direction.

22. The waterproof connector according to claim 19,
wherein the mid-plate includes a pair of the coupling portions arranged on both sides in the alignment direction of the plurality of contacts, and
wherein the pair of protrusions are connected to the pair of coupling portions, respectively.

23. The waterproof connector according to claim 16,
wherein the housing includes a mating connector receiving portion opening forward in the fitting direction, and
wherein the contact portions of the plurality of contacts are exposed at least in the mating connector receiving portion.

24. The waterproof connector according to claim 23,
wherein the housing includes:
a first insulator covering the contact front portions of the plurality of contacts and the front portion of the mid-plate so as to expose the contact portions of the plurality of contacts; and
a second insulator covering the contact-side waterproof shaped portions and the contact back portions of the plurality of contacts, the coupling portion and the rear portion of the mid-plate, and a back portion of the first insulator so as to expose the connection portions of the plurality of contacts, and
wherein the second insulator forms the mating connector receiving portion, and the first insulator seals a bottom portion of the mating connector receiving portion.

25. The waterproof connector according to claim 23, further comprising a metal shell attached to a back portion of the housing and covering the connection portions of the plurality of contacts.

26. The waterproof connector according to claim 23, further comprising a seamless waterproof member surrounding a front end portion of the mating connector receiving portion disposed at a front end portion of the housing in the fitting direction.

27. The waterproof connector according to claim 23, further comprising an inner plate disposed at a bottom portion of the mating connector receiving portion and to be abutted by the mating connector received in the mating connector receiving portion when fitted to the mating connector.

28. The waterproof connector according to claim 16, wherein the housing includes a pair of fixation portions protruding to both sides of the plurality of contacts in an alignment direction, the housing being fixed to the connection target object via the pair of fixation portions.

29. The waterproof connector according to claim 28, wherein the mid-plate includes a pair of protrusions protruding to both sides of the plurality of contacts in the alignment direction and being covered with the pair of fixation portions of the housing.

* * * * *